US009351390B2

(12) United States Patent
Heid

(10) Patent No.: US 9,351,390 B2
(45) Date of Patent: May 24, 2016

(54) RADIANT TUBE AND PARTICLE ACCELERATOR HAVING A RADIANT TUBE

(75) Inventor: Oliver Heid, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 227 days.

(21) Appl. No.: 13/145,202

(22) PCT Filed: Dec. 2, 2009

(86) PCT No.: PCT/EP2009/066227

§ 371 (c)(1),
(2), (4) Date: Jul. 19, 2011

(87) PCT Pub. No.: WO2010/083915

PCT Pub. Date: Jul. 29, 2010

(65) Prior Publication Data

US 2011/0285283 A1 Nov. 24, 2011

(30) Foreign Application Priority Data

Jan. 20, 2009 (DE) ..... 10 2009 005 200

(51) Int. Cl.

| | |
|---|---|
| ***H05H 9/00*** | (2006.01) |
| ***H05H 7/00*** | (2006.01) |
| ***H05H 7/22*** | (2006.01) |
| ***H01J 25/02*** | (2006.01) |
| ***H05H 5/02*** | (2006.01) |

(52) U.S. Cl.

CPC . *H05H 7/00* (2013.01); *H05H 5/02* (2013.01); *H05H 7/22* (2013.01); *H05H 9/005* (2013.01)

(58) Field of Classification Search

CPC ..... H05H 7/00
USPC ..... 315/5, 501, 505, 500, 506; 250/492.3, 250/393, 400, 492.1, 526

See application file for complete search history.

(56) References Cited

U.S. PATENT DOCUMENTS

| | | | | |
|---|---|---|---|---|
| 2,005,021 A * | 6/1935 | Brasch et al. | ..... | 313/239 |
| 2,569,154 A * | 9/1951 | Donath | ..... | 315/382 |
| 3,506,865 A * | 4/1970 | Briggs | ..... | 313/62 |
| 3,617,908 A * | 11/1971 | Greber | ..... | 315/501 |

(Continued)

FOREIGN PATENT DOCUMENTS

| | | | | |
|---|---|---|---|---|
| CN | 101091232 A | 12/2007 | ..... | H01J 35/08 |
| DE | 19523859 A1 | 1/1997 | ..... | H01J 49/04 |

(Continued)

OTHER PUBLICATIONS

International Search Report and Written Opinion for Application No. PCT/EP2009/066227 (12 pages), Apr. 22, 2010.

*Primary Examiner* — Alexander H Taningco
*Assistant Examiner* — David Lotter
(74) *Attorney, Agent, or Firm* — Slayden Grubert Beard PLLC

(57) ABSTRACT

A radiant tube (4) for guiding a charged particle stream (10) has a hollow cylindrical isolation core (6) directly encompassing a beam-guiding hollow volume (8). The isolation core (6) is formed from a dielectrically acting carrier substrate (14) and an electrical conductor (16) held therein. The conductor (16) is divided into a plurality of conductor loops (20) completely encompassing the circumference of the isolation core (6) at different axial positions of the isolation core (6). The conductor loops (20) are galvanically connected to each other.

6 Claims, 1 Drawing Sheet

(56) References Cited

U.S. PATENT DOCUMENTS

| | | | | | |
|---|---|---|---|---|---|
| 3,761,720 | A | * | 9/1973 | Gray et al. | 250/302 |
| 4,225,806 | A | * | 9/1980 | Le Gardeur | 315/5 |
| 4,293,656 | A | * | 10/1981 | Hahn et al. | 521/88 |
| 4,712,042 | A | | 12/1987 | Hamm | H01J 23/24 |
| 5,038,076 | A | * | 8/1991 | Smith et al. | 315/3.5 |
| 5,433,744 | A | * | 7/1995 | Breyen et al. | 607/125 |
| 5,572,035 | A | | 11/1996 | Franzen | H01J 49/42 |
| 5,698,949 | A | * | 12/1997 | Lien et al. | 315/5.31 |
| 5,757,146 | A | * | 5/1998 | Carder | 315/505 |
| 6,331,194 | B1 | * | 12/2001 | Sampayan et al. | 29/25.03 |
| 6,921,042 | B1 | * | 7/2005 | Goodzeit et al. | 242/430 |
| 7,377,228 | B2 | | 5/2008 | Mack | 118/723 CB |
| 7,460,645 | B2 | | 12/2008 | Anno | 378/141 |
| 2007/0278396 | A1 | | 12/2007 | Wu | G01N 27/64 |
| 2009/0039804 | A1 | | 2/2009 | Nishino et al. | H05H 7/00 |

FOREIGN PATENT DOCUMENTS

| | | | | |
|---|---|---|---|---|
| FR | 1028597 | A | 5/1953 | H05H 9/00 |
| FR | 2671908 | A1 | 7/1992 | H01J 3/02 |
| JP | 2006500741 | A | 1/2006 | C23C 16/452 |
| WO | 9833228 | A2 | 7/1998 | H05H 7/22 |
| WO | 2006/043366 | A1 | 4/2006 | H01J 37/04 |
| WO | 2007/026612 | A1 | 3/2007 | H01J 35/08 |
| WO | 2010/083915 | A1 | 7/2010 | H01J 37/02 |

* cited by examiner

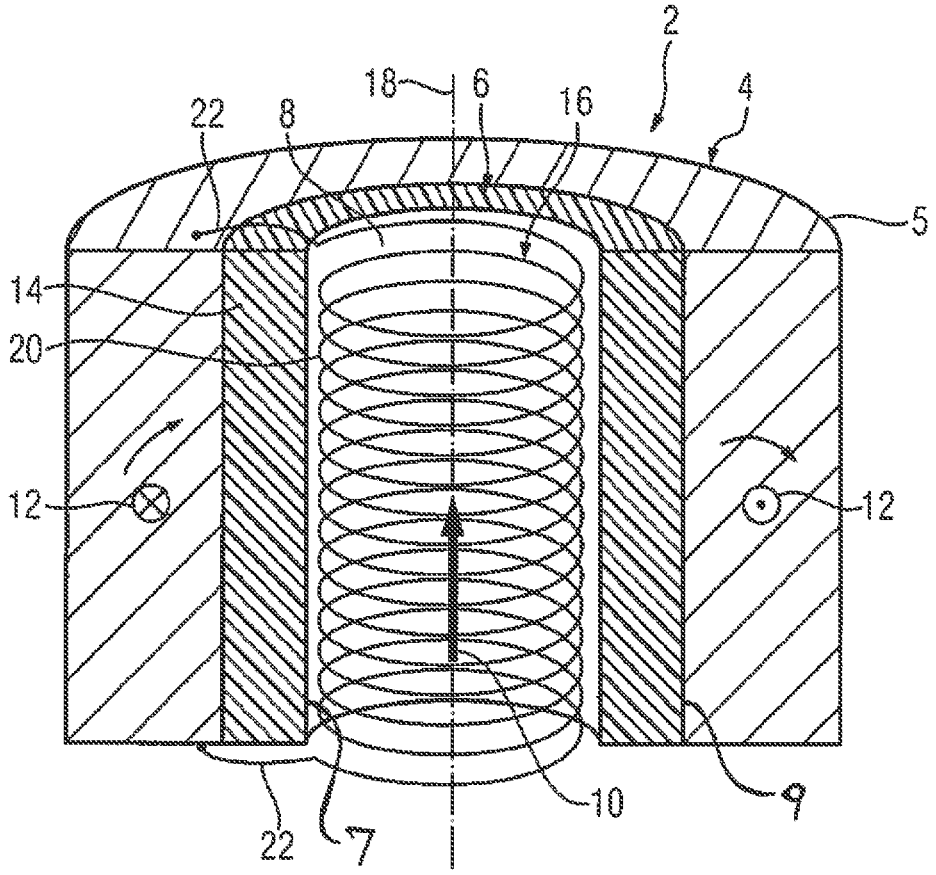
2
18
6
16
4
22
8
5
14
20
12
12
10
9
22
7

RADIANT TUBE AND PARTICLE ACCELERATOR HAVING A RADIANT TUBE

CROSS-REFERENCE TO RELATED APPLICATIONS

This application is a U.S. National Stage Application of International Application No. PCT/EP2009/066227 filed Dec. 2, 2009, which designates the United States of America, and claims priority to German Application No. 10 2009 005 200.3 filed Jan. 20, 2009, the contents of which are hereby incorporated by reference in their entirety.

TECHNICAL FIELD

The invention relates to a beam tube for guiding a charged particle beam, and to a particle accelerator having such a beam tube.

BACKGROUND

Such a beam tube is intended in particular for a particle accelerator for charged particles. The charged particle beam may for example comprise electrons, atomic nuclei, ionized atoms, charged molecules or charged molecular fragments. The acceleration of the charged particle beam takes place in a beam-guiding cavity, which is enclosed by the beam tube. The cavity is conventionally evacuated during operation of the particle accelerator. To this end, a vacuum pump system assigned to the beam tube is conventionally provided.

The beam tube, which separates the cavity and the charged particle beam from the surroundings, has the accelerating electric field electrostatically applied to it. With an increasing field strength of the electric field, the probability that stray electrons will be torn from the surface of the inner wall of the beam tube increases. This process takes place initially and preferentially on so-called whiskers. Whiskers are needle-shaped single crystals with a diameter of a few micrometers and a length of up to several hundred micrometers, which occur on all surfaces, in particular metallic surfaces. An increased electric field occurs at the tip of a whisker. Stray electrons are thereby torn from the tip of the whisker. The stray electrons are then accelerated by the electric field, just like the charged particle beam. If such stray electrons strike the inner wall of the beam tube, then secondary electrons will be detached by the impact. The process is self-sustaining. Finally, arcing takes place on the inner wall, and therefore collapse of the electric field accelerating the charged particles.

In order to resolve this problem, U.S. Pat. No. 6,331,194 B1 discloses a beam tube in which the cavity guiding the particle beam is directly enclosed by a hollow cylindrical isolation core, which is referred to as a high gradient insulator, HGI. The isolation core comprises a number of thin rings made of a dielectric (thickness about 0.25 mm), which are respectively provided with a thin metallically conductive layer (thickness about 40 000 angstroms) on their main faces. In order to produce the isolation core, the rings are assembled to form a hollow cylinder. Under the effect of pressure and heat, the adjacent metal layers of neighboring rings melt and fuse to form metal rings.

The HGI increases the sparkover resistance of the beam tube. This is because if secondary electrons are formed on the inner wall of the HGI, then the neighboring metal rings of the HGI become charged. The electric charge is therefore distributed over all metal rings directly exposed to the secondary electrons. This leads to homogenization of the electric charge on the inner wall of the HGI, and therefore a reduced tendency to secondary electron multiplication.

The distribution of the electric charge over neighboring thin metal rings is purely capacitive distribution. The principle therefore works only for infrequent and short voltage pulses. Charging of the metal rings is not effectively prevented, since the metal rings are embedded in the dielectric of the insulator core and the applied charge can only flow away slowly through leakage paths. Operation of the linear accelerator with a high rate of acceleration pulses therefore leads to an increasing sparkover probability.

SUMMARY

According to various embodiments, a beam tube can be provided which has a low sparkover probability. Furthermore, according to various embodiments, a particle accelerator can be provided having such a beam tube.

According to an embodiment, a beam tube for guiding a charged particle beam, may comprise a hollow cylindrical isolation core which directly encloses a beam-guiding cavity and is formed from a dielectrically acting carrier substrate and an electrical conductor held therein, wherein the conductor is divided into a plurality of conductor loops which extend fully around the circumference of the isolation core at different axial positions and are DC-connected to one another.

According to a further embodiment, metal layers, which are arranged in succession along the axis of the beam tube and are DC-connected to one another by the electrical conductor, are placed in the carrier substrate. According to a further embodiment, the conductor loops may form a helical coil. According to a further embodiment, the conductor can be embedded in the carrier substrate. According to a further embodiment, the conductor may pass entirely through the carrier substrate. According to a further embodiment, the beam tube may have a metal housing enclosing the isolation core. According to a further embodiment, the conductor can be DC-conductively connected to the housing at least at one point. According to a further embodiment, the conductor can be DC-connected to the housing at least two mutually separated points, in particular on one side. According to a further embodiment, the conductor and the carrier substrate can be wire-shaped and are wound as a double helix.

According to another embodiment, a particle accelerator, in particular a linear accelerator, may have a beam tube as described above.

BRIEF DESCRIPTION OF THE DRAWINGS

An exemplary embodiment of the invention will be explained in more detail below with the aid of the drawing.

FIG. 1 shows a subregion of a particle accelerator 2 with a section of a beam tube 4 in a three-dimensional sectional view.

DETAILED DESCRIPTION

According to various embodiments, the beam-guiding cavity is directly enclosed by a hollow cylindrical isolation core. The isolation core is formed from a dielectrically acting carrier substrate and an electrical conductor held therein. The conductor is divided into a plurality of conductor loops which extend fully around the circumference of the isolation core at different axial positions. The individual conductor loops are DC-connected to one another.

A metal such as copper, gold or the like may be employed as the electrical conductor. For example, $SiO_2$, $Al_2O_3$, a polycarbonate, a polyacrylic, a glass or a ceramic may be used as the dielectric.

In particular, metal layers, for example metal plates, which are arranged in succession along the beam tube may be placed in the dielectrically acting carrier substrate. The metal layers serve as intermediate electrodes. The metal layers are DC-connected to one another by the electrical conductor. The structure therefore corresponds essentially to the HGI mentioned in the introduction. Electrons which may have impacted can flow away owing to the DC connection of the metal layers.

In an inductive particle accelerator having such a beam tube, however, a low-impedance connection of the metal layers would lead to loading of the induction generator and therefore a reduction of the acceleration voltage. By the electrical conductor configured in conductor loops, it is nevertheless possible to ensure that the metal layers essentially are inductively coupled to the beam tube surface. This is advantageous in particular for pulsed operation of the beam tube. Capacitive coupling of the insulator sections to a metal electrode in the vicinity is thereby achieved. Possible charges can however flow away in a time which is short (but long in relation to an acceleration period), so that the self-diverging sparkover process is suppressed even with high repetition rates.

If secondary electrons are now formed on the inner wall of the insulator core, which faces the cavity, then a number of neighboring conductor loops will be exposed directly and pointwise to the electric charge of the secondary electrons. The electric charge is now distributed in the circumferential direction of these conductor loops. Since all the conductor loops are DC-connected to one another, the charge is also distributed over the conductor loops which do not come directly in contact with the secondary electrons. The probability of secondary electron multiplication and sparkover of the insulator is therefore effectively reduced. A particle accelerator having such a beam tube can therefore be operated with a high rate of acceleration pulses and/or with an increased field energy, without the sparkover probability increasing significantly.

According to various embodiments, the beam tube is enclosed by a metal housing. Such a metal housing may, for example, be made from tubular pieces sealed together, and can straightforwardly be evacuated by means of a vacuum pump system in order to provide the beam-guiding evacuated cavity. The metal housing may, however, also comprise a device intended to provide the accelerating electric field or form a part of such a device.

According to an embodiment, the electrical conductor held on the dielectric carrier substrate is DC-conductively connected to the metal housing at least at one point.

According to an embodiment, at least two mutually separated points of the electrical conductor are DC-connected to the housing. There is therefore no potential gradient inside the electrical conductor.

The conductor loops may be formed annularly closed and DC-connected to one another by a number of conductor bridges essentially extending in the length direction of the cylinder.

According to an embodiment, however, the conductor loops of the electrical conductor are wound in the manner of a screw helix around the longitudinal mid-axis of the hollow cylindrical insulator core, and thus form a helical coil. The conductor thus acts as an inductor and attenuates radiofrequency components of the accelerating electric field.

According to an embodiment, the electrical conductor is embedded in the dielectrically acting carrier substrate. In order to produce the isolation core, for example, a mold is provided which has the configuration of a hollow cylinder comprising a cylindrical core for forming an annular space. For example, the electrical conductor curved in the manner of a screw helix, which consists of a metal wire, is placed in the annular space. The annular space is subsequently filled with the dielectrically acting carrier substrate in order to form the hollow cylindrical isolation core together with the electrical conductor. The dielectric is for example a pourable plastic compound, such as a synthetic resin or the like, which solidifies after the mold has been filled with it. It may, however, also be a powdered dielectric which is introduced into the mold as a pourable bulk material and solidified by applying heat and/or pressure.

According to another embodiment, the electrical conductor is fastened, for example adhesively bonded, on the inner wall of the hollow cylindrical carrier substrate. The electrical conductor may also be printed on or vapor deposited in this case.

According to another embodiment, both the electrical conductor and the dielectrically acting carrier substrate are formed as wire-shaped strips and wound together in the shape of a double helix in order to form the hollow cylindrical isolation core. In order to produce this shape of the isolation core, the two strips are for example wound around a cylinder as a mounting aid and subsequently fastened to one another.

All the described variants for the manufacture of the hollow cylindrical isolation core are comparatively simple and therefore economical to carry out.

In the final manufactured state, the electrical conductor preferably passes entirely through the carrier substrate. In other words, both the inner wall and the outer wall of the hollow cylindrical isolation core have a metallically conductive component. A large amount of electrically conductive material, which is suitable for absorbing a large amount of electric charge, can therefore be built into the isolation core.

According to various embodiments, the particle accelerator may for example be used for research purposes, but also as a medical therapy device. The particle accelerator is in particular configured as a dielectric wall accelerator, DWA, as described in detail in U.S. Pat. No. 5,757,146.

The particle accelerator may in particular be operated in pulsed mode and be based on electromagnetic induction, i.e. the accelerating electric field is generated by a magnetic flux change around the particle flight path.

The particle accelerator 2 is configured for example as a linear accelerator, in which the accelerating electric field is provided by a DC voltage or by a pulsating AC voltage (cf. Wideröe linear accelerator, 1928). It may, however, also be formed as a dielectric wall accelerator.

The beam tube 4 is represented merely schematically as a hollow cylinder. It comprises a tubular metal housing 5. It may however also comprise auxiliary devices, for example a vacuum pump system (not represented in the FIGURE). The beam tube 4 accommodates a likewise hollow cylindrical isolation core 6. The isolation core 6 in turn directly encloses a beam-guiding cylindrical cavity 8. A charged particle beam 10 (only indicated symbolically) is guided and accelerated in the cavity 8.

The particle accelerator 2 is based on the principle of electromagnetic induction. It generates a magnetic field 12 (symbolically indicated in the FIGURE) around the particle flight path, which coincides with the direction arrow for the charged particle beam 10. In the FIGURE, the magnetic field 12 forms closed field lines around the cavity 8, or around the particle flight path of the charged particles 10. By time variation of the magnetic flux of the magnetic field 12, an electric field (not represented in the FIGURE) is generated which accelerates the charged particle beam 10 in the arrow direction.

The hollow cylindrical isolation core 6 is formed from a dielectrically acting carrier substrate 14 and an electrical conductor 16 held therein. The electrical conductor 16 is divided into a plurality of conductor loops 20 which extend around the circumference of the isolation core 6 at different positions, as seen from its longitudinal mid-axis 18. The conductor loops 20 are DC-connected to one another and thus form a helical coil.

In the dielectrically acting carrier substrate 14, metal layers, for example metal rings, may be placed (this is not shown here) in succession along the axis of the beam tube. In this case, the dielectrically acting carrier substrate has a structure as shown hi FIG. 2A of U.S. Pat. No. 6,331,194 B1, which shows a hollow cylindrical member 20 formed from a dielectric material with parallel circular-ring trenches filled with metal on both the inside and outside surfaces of the hollow cylindrical member, to form a series of inside parallel metal rings 23-26 and outside parallel metal rings 27-29, as discussed as col. 6, lines 62 to col. 7, line 20 of the patent. The metal rings are connected to one another by the circumferential conductor loops 20. Electrons which may have impacted can flow away owing to the DC connection of the metal layers.

In order to manufacture the isolation core 6, for example, the electrical conductor 16 is curved in the manner of a screw helix and fastened on the inner wall 7 of the hollow cylindrical carrier substrate 14. The electrical conductor may, however, also be printed onto the inner wall 7 of the hollow cylindrical carrier substrate 14 by means of a metallically conductive paste, such as is used to print conductor tracks on printed circuit hoards.

The two ends of the helical electrical conductor 16 are connected via electrically conductive connections 22 to the beam tube 4, or its metal housing 5, and therefore to the ground potential of the particle accelerator 2.

The cavity 8 is evacuated during operation of the particle accelerator 2.

Stray and secondary electrons, which have become detached from the beam tube wall by the accelerating electric field, strike one or more conductor loops 20 of the electrical conductor 16 upon impact on the isolation core 6, and charge them. Owing to the DC connection of the conductor loops 16 with one another, the charge of the secondary electrons is distributed along the electrical conductor 16 in the direction of the longitudinal mid-axis 18. This reduces the risk of secondary electron multiplication and therefore the sparkover probability of the particle accelerator 2. The particle accelerator 2 can therefore be operated with a high accelerating electric field strength and a high rate of acceleration pulses.

Owing to the formation of the electrical conductor 16 in the manner of a coil, radiofrequency AC electric fields are furthermore filtered out.

LIST OF REFERENCES

2 particle accelerator
4 beam tube
6 isolation core
8 cavity
10 charged particle beam
12 magnetic field
14 carrier substrate
16 electrical conductor
18 longitudinal mid-axis
20 conductor loop
22 electrically conductive connection

What is claimed is:

1. A beam tube for guiding a charged particle beam, comprising:

a hollow cylindrical isolation core defining continuous cylindrical inner and outer walls, the inner wall defining a cylindrical beam-guiding cavity radially inward of the continuous cylindrical inner wall, the core formed from a dielectrically acting carrier substrate;

an electrical conductor held within the cavity positioned in close proximity to the core inner wall for close exposure to an electric charge of secondary electrons formed on the inner wall of the core, wherein the conductor is divided into a plurality of conductor loops, each loop (a) extending fully around the circumference of the beam-guiding cavity at different axial positions, (b) are fully located radially inward of the continuous cylindrical inner wall of the hollow cylindrical isolation core, and (c) are conductively connected to one another; and a metal housing directly enclosing the outer cylindrical wall of the hollow cylindrical isolation core;

wherein the electrical conductor is conductively connected to the cylindrical housing at two or more mutually separated points.

2. The beam tube according to claim 1, wherein the conductor loops form a helical coil.

3. A particle accelerator having a beam tube comprising:

a hollow cylindrical isolation core comprising cylindrical inner and outer walls the inner wall defining a cylindrical beam-guiding cavity radially inward of the inner wall of the hollow cylindrical isolation core, the core formed from a dielectrically acting carrier substrate;

a metallic conductive paste printed on the inner wall of the hollow cylindrical isolation core for close exposure to an electric charge of secondary electrons formed on the inner wall of the core, wherein the conductor is divided into a plurality of conductive loops which are in contact with the beam-guiding cavity at different axial positions, and are conductively connected to one another such that the electric charge of secondary electrons is distributed in a circumferential direction of the conductive loops; and a metal housing directly enclosing the outer wall of the hollow cylindrical isolation core;

wherein the metallic conductive paste is conductively connected at least twice to the housing at separate points.

4. The particle accelerator according to claim 3, wherein the conductor loops form a helical coil.

5. The particle accelerator according to claim 3, wherein the particle accelerator is a linear accelerator.

6. A method for operating a particle accelerator having a beam tube for guiding a charged particle beam, comprising:

providing a hollow cylindrical isolation core defining a continuous cylindrical inner wall which (a) directly encloses a beam-guiding cavity defined radially inward of the hollow cylindrical isolation core and (b) is formed from a dielectrically acting carrier substrate;

providing an electrical conductor held in close proximity to the inner wall of the core for close exposure to an electric charge of secondary electrons formed on the inner wall, dividing the conductor into a plurality of conductor loops which (a) extend fully around a circumference of the beam-guiding cavity at different axial positions, (b) are fully located radially inward of the continuous cylindrical inner wall of the hollow cylindrical isolation core, and (c) are conductively connected to one another to distribute the electric charge of secondary electrons in the circumferential direction of the conductor loops; and providing a metal housing directly enclosing an outer cylindrical wall of the hollow cylindrical isolation core;

wherein the electrical conductor is conductively connected at least twice to the housing at separate points.

* * * * *